US005947390A

United States Patent [19]

Smith

[11] Patent Number: 5,947,390

[45] Date of Patent: Sep. 7, 1999

[54] REDUCED EMISSIONS FLOW CONTROL PLATE

[76] Inventor: Gary L Smith, 1760 Monrovia Ave., Unit C-1, Costa Mesa, Calif. 92627

[21] Appl. No.: 09/000,855

[22] Filed: Dec. 30, 1997

[51] Int. Cl.[6] ..... B05B 1/20; B05B 1/14

[52] U.S. Cl. ..... 239/566; 239/418; 239/419; 239/428; 239/561; 239/596

[58] Field of Search ..... 239/418, 419, 239/419.3, 422, 428, 548, 561, 566, 596

[56] References Cited

U.S. PATENT DOCUMENTS

| | | | |
|---|---|---|---|
| D. 287,266 | 12/1986 | Knetl et al. . | |
| 733,571 | 7/1903 | Allen | 239/596 |
| 1,401,911 | 12/1921 | Keller | 239/566 X |
| 1,485,495 | 3/1924 | Eldred et al. | 239/561 |
| 2,407,370 | 9/1946 | Hughey | 239/418 X |
| 3,659,787 | 5/1972 | Ito . | |
| 3,801,009 | 4/1974 | Marshall, III . | |
| 3,870,232 | 3/1975 | Lacchia | 239/566 X |
| 4,236,674 | 12/1980 | Dixon . | |
| 4,346,849 | 8/1982 | Rood . | |
| 4,386,739 | 6/1983 | Kwok . | |
| 4,579,286 | 4/1986 | Stoudt . | |
| 4,618,098 | 10/1986 | Hedger, Jr. et al. . | |
| 4,928,884 | 5/1990 | Smith . | |
| 5,452,856 | 9/1995 | Pritchard . | |
| 5,613,637 | 3/1997 | Schmon . | |
| 5,655,255 | 8/1997 | Kelly . | |

FOREIGN PATENT DOCUMENTS

| | | | |
|---|---|---|---|
| 348332 | 4/1905 | France | 239/566 |

*Primary Examiner*—Andres Kashnikow
*Assistant Examiner*—Robin O. Evans
*Attorney, Agent, or Firm*—James G. O'Neill

[57] ABSTRACT

A flow control device for mounting on a plural component spray gun for controlling the fan spray pattern of mixed components sprayed from the spray gun. A plurality of circular holes are formed in a single row in the flow control device at angles with respect to each other, so as to precisely control the flow of mixed material sprayed from the spray gun, without atomizing such material to thereby reduce harmful emissions.

17 Claims, 1 Drawing Sheet

REDUCED EMISSIONS FLOW CONTROL PLATE

BACKGROUND OF THE INVENTION

1. Field of the Invention:

This invention relates generally to spray guns and, more particularly, to flow control plate to reduce harmful emissions in a spray component system.

2. Description of Related Art

In sophisticated spray component systems, known as plural component systems, two or more components are concurrently sprayed from a spray gun. One of the most useful plural component systems is a fiberglass system. In such a system, a first component, composed of a resin, is sprayed from one nozzle, and a second component, composed of a catalyst, is fed from another nozzle and mixed in a spray directly in front of the spray gun. As soon as the components are mixed, a reaction starts, polymerizing the resin into a solid, coherent mass. However, when the resin is atomized into a spray pattern, misting occurs, resulting in lower fiberglass and resin transfer rates and higher styrene emissions. Spraying of a third component, such as a "chop" into such mixed sprays significantly reduce styrene emissions. Therefore, fiberglass spray guns may be augmented by including a chopper assembly which chops up a fiberglass roving and concurrently sprays short segments of fiberglass into the spray pattern of the mixed resin and catalyst ejected from the resin and catalyst nozzles. This composite, mixed with the short fiberglass strands embedded in the catalyzed resin, is directed to a surface for polymerization on the surface to form the fiberglass article.

Other known equipment mixes components, such as resin and catalyst at a manifold somewhere in or behind the spray gun. Such equipment then sprays a mix of components at a high pressure and high velocity, combined with blown air, and a chop, which may be liquid or powder is directed into the mix, to create a fiberglass or other materials. In such equipment, as well as the fiberglass spray gun mentioned above, the components can be mixed at the nozzle before it flows out in front of the gun in a fan-type pattern at a pressure of about 1,000 lbs. The chopped fiberglass, liquid or powder is then mixed with the fan type pattern in front of the nozzle. As is well known, when using an airless tip, with oblong holes or openings, the components are normally atomized. However, because of increased awareness of the environment and stricter Federal and State controls, particularly those of California, the atomized components in the fan spray emitted by nozzles in known spray guns is unacceptable. Therefore, elimination of emissions, from a spray pattern emitted by such spray guns has become a top priority. However, known nozzles or systems do not provide sufficient control of the flow of the mixed components materials into the fan spray pattern, nor do they is sufficiently cut down on emissions.

Therefore, there exists the need in the art for an easy to manufacture and use means to control emissions from a fan spray pattern of mixed components emitted by a spray gun.

SUMMARY OF THE INVENTION

Accordingly, it is a general object of the present invention to provide an improved flow control means. It is a particular object of the present invention to provide an improved reduced emissions flow control element for a spray gun. It is a still more particular object of the present invention to provide an improved flow control device for a spray gun which reduces styrene and other regulated emissions. It is yet another more particular object of the present invention to provide an improved flow control system for a plural component spray gun, which flow control system has a single row of spaced-apart openings. It is a further particular object of the present invention to provide an improved flow control system to control the spray of mixed material in a component mixture exiting from a spray gun, having a plurality of angled openings therein.

In accordance with one aspect of the present invention, there is provided a flow control device having a plurality of openings formed in a single row therein, for mounting to a plural component spray gun to control the direction of flow of mixed material exiting from the spray gun in a fan spray pattern, and reducing harmful emissions from the fan spray pattern.

BRIEF DESCRIPTION OF THE DRAWINGS

The objects and features of the present invention, which are believed to be novel, are set forth with particularity in the appended claims. The present invention, both as to organization and manner of operation, together with further objects and advantages, may best be understood by reference to the following description, taken in conjunction with the accompanying drawings, in which:

DESCRIPTION OF THE PREFERRED EMBODIMENTS

The following description is provided to enable any person skilled in the art to be able to use the invention and sets forth the best modes contemplated by the inventor for carry out his invention. Various modifications, however, will remain readily apparent to those skilled in the art, since the generic principals of the present invention have been defined herein, specifically to provide for a novel and improved flow control means, device, element or plate 10.

The flow control device 10 is described in connection with use in a spray gun 12, which internally mixes and sprays out two components such as a resin and a catalyst in a fan spray pattern.

This spray gun may be operated at lower pressures, from 50 lbs. to about 600 lbs. It is to be understood, however, that this flow control device could also be used with other spray guns using liquids, powders or similar materials that are sprayed from this spray gun.

Figure 1:
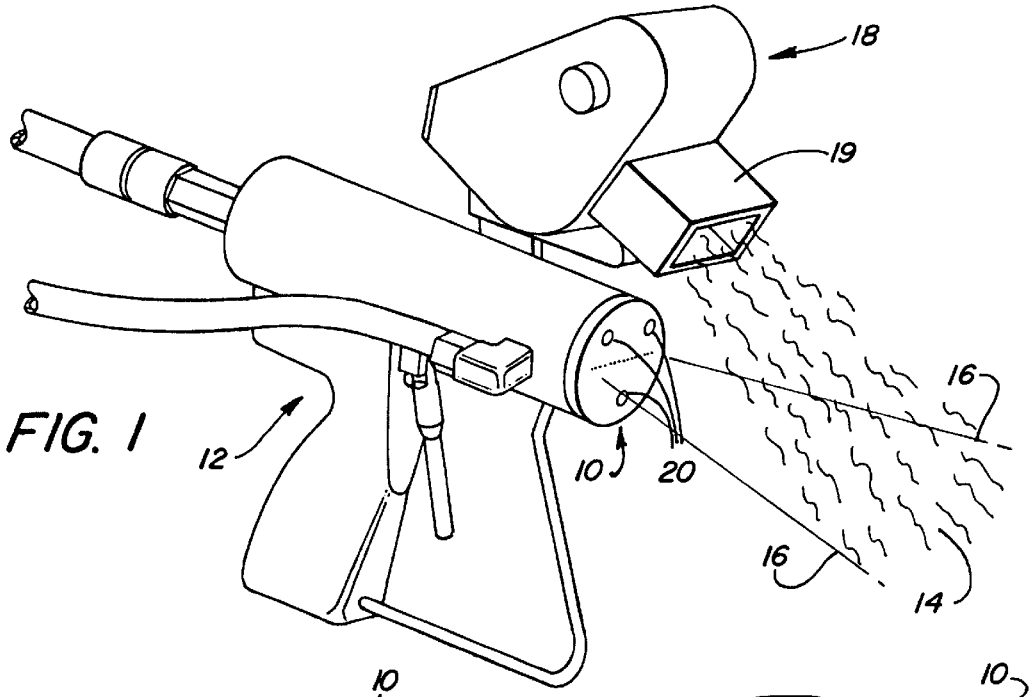
FIG. 1 is a perspective view of a plural component spray gun, such as a fiberglass system having a chopper system with an improved flow control device of the present invention mounted on the front of the spray gun.

Turning now to FIG. 1, there shown is the spray gun 12 capable of internally mixing, in a known manner, and spraying out a plural component system, such as a fiberglass component system through the flow control device 10. The outer boundaries of a fan spray pattern ("fan") 14, such as from a fiberglass component system, is defined by lines 16 on either side thereof. A standard or improved chopper system 18 is mounted to and driven on the spray gun 12, in a manner well known to those skilled in the art. This chopper system 18 may include an adjustable flow control means, such as a chopper diverter 19.

The flow control means or plate 10 is held in place on the front of the spray gun 12, in any desired manner, such us by a plurality of holding means 20, for example, bolts or screws, held in apertures 22 formed in plate 10. The flow control plate 10 may take any shape, but is preferably formed having a substantially cylindrical body with front and rear faces or surfaces 21, 23, having the plurality of apertures 22, three in the embodiment shown, formed therein. The cylindrical body 10 may be of any desired thickness and be made in any desired manner from any material, such as aluminum, or a similar metal or plastic. Although the plate 10 may have any desired thickness, in a preferred embodiment the cylindrical body is made approximately 0.15 inches thick, and is closely machined so as to be sized and dimensioned to enable the rear face to fit snugly on and sealingly cooperate with the front of the spray gun 12, as shown in FIG. 1.

The cylindrical flow control plate 10 includes a central flow control area 24 comprised of a single row of a plurality of holes or openings 25, 26. These holes include a central hole 25, which is preferably formed so as to be circular and perpendicular to the outside and rear faces or surfaces 21, 23 of the cylindrical flow control plate 10. The remaining holes 26 are preferably formed, so as to be circular and angled with respect to the central hole 25, and each other. The angle of each hole 26 increases as one moves outwardly, away from the central hole 25, along the single row 24. The circular holes 25, 26 control the flow of material, such as mixed resin and catalyst flowing from a shallow, narrow groove 27, formed in the rear face 23. Each of the holes 26 are angled at approximately 1°, with respect to adjacent holes 26, or central hole 25, and all of the holes are of a size to enable fluid flow, without atomization, to control the flow of the mixed components and substantially reduce emissions. Additionally, the elongated, shallow, narrow groove 27 allows greater control of the flow of the mixed components since it is not deep enough to allow material to solidify therein and eventually flake off to block the holes 25, 26, which together with the size and shape of the holes 25, 26, prevents atomization (allows the mixed components to exit as a fluid stream), thus eliminating or minimizing harmful emissions.

Figure 2:
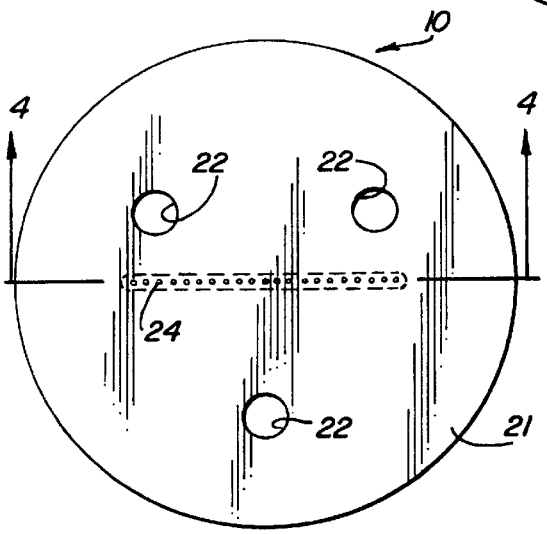
FIG. 2 is a front elevational view of a preferred embodiment of the flow control device of the present invention.
Figure 3:
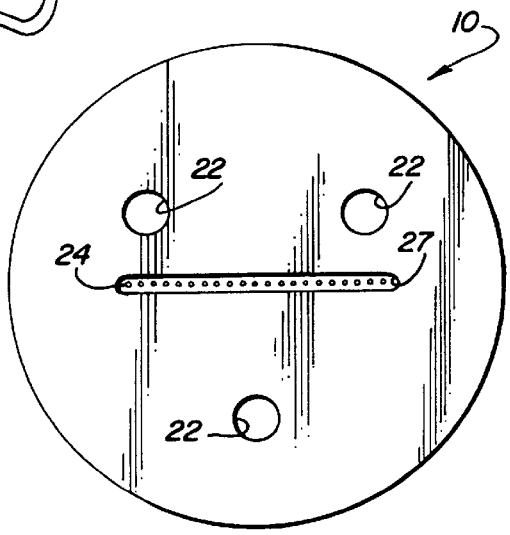
FIG. 3 is a rear elevational view of FIG. 2.
Figure 4:
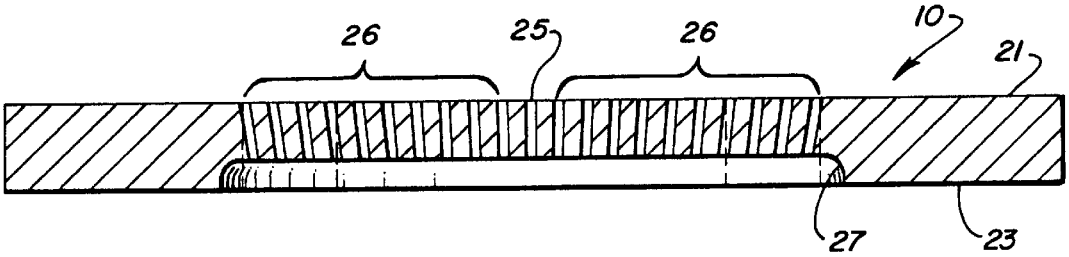
FIG. 4 is a sectional view of the flow control device of FIG. taken along lines 4—4.

Turning now to FIGS. 2–4, there shown in more detail is a preferred embodiment of the flow control plate 10. The flow control plate 10 preferably includes from 19 to 21 holes 25, 26 in a single line or row 24. As discussed above, although the body of the plate 10 may be of any desired shape, it is preferably cylindrical with a substantially flat front face 21 and a substantially flat rear face 23, having the holes 25, 26 formed centrally thereon in the single row 24. The central hole 25 is perpendicular to the front and rear faces 21, 23, while each of the remaining holes 26 is drilled or formed at an angle to each other hole. That is, as these holes 26 are spaced outwardly from the central hole 25, each hole 26, (from 9 to 10 openings on each side of the central hole 25 to make a single row of 19 or 21 holes), is made at an angle approximately 1° different or greater than the preceding hole. As best shown in FIG. 4, the holes 26 on each side of the central hole 25 would start at an angle of about 89°, while the outermost holes on each side would be at angles of about 83° (if 19 holes), or about 82° (if 21 holes) . To insure proper fluid flow and prevent atomization, each hole is approximately 0.018" in diameter and is spaced about 0.050 inches apart from adjacent holes.

In use, the flow control plate 10 of the present invention is secured to the front of spray gun 12, as by means of threaded bolts or screws 20 passing through apertures 22 in the plate 10 and secured in the front of the spray gun. Then, after the plural components have been mixed in the spray gun 12, the mixed components will enter the long, shallow groove 27 and flow out the holes 25, 26 in a controlled spray pattern of fluid streams, similar to a shower head, without atomization, thus entirely eliminating or causing a minimum of harmful emissions. The flow control plate of the present invention, operated at lower pressure (from 50 lbs. to 600 lbs.), prevents overspray.

It, thus, can be seen that the flow control device of the present invention provides an improved and easy-to-use system for preventing overspray, by accurately controlling fluid material being sprayed from a spray gun, to improve the operation of a fiberglass or other spray guns, so as to both save material and reduce harmful emissions.

Those skilled in the art will appreciate that various adaptations and modifications of the just-described, preferred embodiments can be configured without departing from the scope and spirit of the invention. Therefore, it is to be understood that, within the scope of the appended claims, the invention may be practiced other than as specifically described herein.

What is claimed is:

1. A flow control system for controlling the flow of mixed components exiting at pressure from a plural component system spray gun comprising, in combination;

a body;

a plurality of securing elements for securing the body to a front portion of the spray gun to control the spray emitted by the spray gun;

a plurality of holes formed in a single row in the body; and the plurality of holes extending through the body from a front face to a shallow groove formed in a rear face and being formed at an angle with respect to adjacent openings.

2. The flow control system of claim 1 wherein the shallow groove formed on the rear face is elongated and narrow to control the flow of material to the plurality of holes.

3. The flow control system of claim 2 wherein there are between 19 and 21 holes formed in the body.

4. The flow control system of claim 3 wherein the body is substantially cylindrical and made from metal.

5. The flow control system of claim 3 wherein the body is substantially cylindrical and made from plastic.

6. The flow control system of claim 1 wherein the plurality of holes are circular.

7. The flow control system of claim 6 wherein the plurality of holes allow a plurality of fluid streams, at different angles, to be sprayed therefrom.

8. The flow control system of claim 7 wherein the plurality of holes comprise a central hole which is perpendicular to the body, and a series of adjacent holes spaced outwardly from the central hole, and at an angle of approximately 1° less than a preceding hole.

9. A method of controlling the flow of pressurized mixed components being sprayed from a spray gun, comprising the steps of:

providing the spray gun with a control plate to control flow;

providing the control plate with a plurality of holes in a single row to precisely control flow therethrough without atomization; and providing that a rear face on the control plate has a shallow groove to receive the pressurized mixed components and at least some of the plurality of openings are at an angle with respect to each other to form a fan spray of the flow of the mixed component from the spray gun, while reducing emissions.

10. The method of claim 9, further including the step of providing that the shallow groove is elongated and narrow to control receipt of the pressurized mixed components before they are sprayed through the plurality of holes.

11. A combination flow control device and a spray gun, comprising;

a spray gun which mixes a pair of components internally before such pair of components reach a flow control device;

the flow control device being mounted on a front portion of the spray gun by a plurality of securing elements;

the flow control device including a body having a front face and a rear face;

a plurality of holes formed in the body in a single row; and extending between the rear face and the front face; and an elongated, narrow, shallow groove formed in the rear face of the flow control device and being connected to the plurality of holes for controlling receipt of the mixed components before the mixed components are sprayed at pressure through the plurality of holes.

12. The combination flow control device and spray gun of claim 11 wherein the plurality of holes are formed at angles with respect to each other.

13. The combination flow control device and spray gun of claim 12 wherein there are between 19 and 21 holes formed in the single row in the body.

14. The combination flow control device and spray gun of claim 13, wherein a central hole in the single row of the plurality of holes is formed perpendicularly to the body.

15. The combination flow control device and spray gun of claim 14 wherein the remaining holes are formed at angles with respect to adjacent holes as they are spaced outwardly from the central hole.

16. The combination flow control device and spray gun of claim 15 wherein each hole spaced from the central hole is formed so as to be at an angle approximately 1° different from adjacent holes.

17. The combination flow control device and spray gun of claim 16 wherein the body is substantially cylindrical and the plurality of holes are circular.

* * * * *